United States Patent [19]

Simmons

[11] Patent Number: 4,828,036

[45] Date of Patent: May 9, 1989

[54] APPARATUS AND METHOD FOR PUMPING WELL FLUIDS

[75] Inventor: Peter E. Simmons, London, England

[73] Assignee: Shell Oil Company, Houston, Tex.

[21] Appl. No.: 332

[22] Filed: Jan. 5, 1987

[51] Int. Cl.[4] ..... E21B 43/12

[52] U.S. Cl. ..... 166/369; 166/105.5; 415/67; 415/68; 415/72; 415/201; 417/406

[58] Field of Search ..... 166/68, 68.5, 105, 105.5, 166/106, 369; 415/60, 66, 67, 68, 72, 75, 176, 201; 417/405, 406

[56] References Cited

U.S. PATENT DOCUMENTS

| | | | |
|---|---|---|---|
| 269,167 | 12/1882 | Baxter . | |
| 631,691 | 8/1899 | Blot | 415/75 |
| 1,693,102 | 11/1928 | Worthington . | |
| 1,702,838 | 2/1929 | Oliphant . | |
| 2,080,622 | 5/1937 | McMahon | 166/105.5 |
| 2,100,560 | 11/1932 | Kennedy | 417/406 |
| 2,102,140 | 12/1937 | Ungar | 221/95 |
| 2,119,736 | 6/1938 | Coberly | 103/46 |
| 2,269,189 | 1/1942 | Downs | 103/5 |
| 2,804,260 | 8/1957 | Nilsson et al. | 230/139 |
| 2,910,948 | 11/1959 | Betzen | 103/118 |
| 3,184,155 | 5/1965 | Crooks | 230/139 |
| 3,282,495 | 11/1966 | Walls | 416/122 R |
| 3,347,169 | 9/1966 | Cronin et al. | 103/117 |
| 3,693,601 | 9/1972 | Sauder | 123/8.41 |
| 3,802,803 | 4/1974 | Bogdanov | 417/211.5 |
| 4,003,678 | 1/1977 | David | 417/88 |
| 4,086,304 | 4/1978 | David | 417/88 |
| 4,237,976 | 12/1980 | Wilson | 166/297 |
| 4,292,011 | 9/1981 | Erickson | 417/53 |
| 4,386,654 | 6/1983 | Becker | 166/369 |
| 4,514,090 | 4/1985 | Neubauer et al. | 366/300 |
| 4,614,232 | 9/1986 | Jürgens et al. | 166/105.5 |

OTHER PUBLICATIONS

"History of Petroleum Engineering", American Petroleum Institute, 1961, p. 700.

*Primary Examiner*—William P. Neuder

[57] ABSTRACT

A fluid driven downhole apparatus is disclosed for pumping a fluid, such as crude oil, from a well in which a housing contains a twin rotor screw type positive displacement motor and a twin rotor screw type positive displacement pump and the screw rotors of said pump and motor are mounted on a pair of common parallel shafts.

19 Claims, 1 Drawing Sheet

APPARATUS AND METHOD FOR PUMPING WELL FLUIDS

BACKGROUND OF THE INVENTION

The invention relates to an apparatus and method for pumping a fluid, such as crude oil, from a well. The invention relates in particular to a fluid driven downhole apparatus for pumping well fluids to the surface and to a method of using the apparatus.

When the formation drive pressure diminishes to a point where insufficient liquid flows from the formation into a well it may be necessary to install pumping means in the well in order to create an artificial lift. Besides beam or rod pumps and gas lift systems, two main types of downhole pumps, namely submersible electric pumps and hydraulically driven downhole pumps, are currently available.

Electric submersible pumps are generally of the centrifugal type and because the pump has to be accommodated in a relatively small diameter tube, the impellers are of small diameter, resulting in a low head per stage and therefore a large number of stages, and a very long pump. Apart from hydraulic jet pumps, which are rather inefficient, presently available hydraulically driven downhole pumps are generally of the turbine type. These do not require as many stages as the electric type, because they are able to operate at higher speeds. However, they are only suitable for relatively high flow rates. The turbine pump furthermore employs high fluid velocities and narrow fluid passages which gives rise to a high wear rate and thus to frequent maintenance if the produced fluid is sand bearing.

SUMMARY OF THE INVENTION

The object of the invention is to provide a compact and reliable fluid driven downhole pumping apparatus which has a low wear rate even if the produced fluid is sand bearing and which can be easily installed in and retrieved from a well.

A downhole pumping apparatus according to the present invention comprises a housing containing a twin rotor screw type positive displacement motor having a driving fluid inlet and a driving fluid outlet, and a twin rotor screw type positive displacement pump having a production fluid inlet and a production fluid outlet. The apparatus further comprises a pair of parallel shafts rotatably mounted in the housing, each shaft carrying a screw rotor of said pump and a screw rotor of said motor.

A further object of the invention is to provide a method of producing fluids from a well using the fluid driven downhole pumping apparatus. The method comprises lowering the apparatus through a production tubing in a well, anchoring the apparatus at a selected depth inside said tubing, bringing the production fluid inlet and outlet in fluid communication with the interior of the tubing section below and above the apparatus, respectively, bringing the driving fluid inlet in fluid communication with a well annulus surrounding the tubing, and injecting driving fluid via the well annulus into the driving fluid inlet thereby activating the apparatus to pump well fluids via the production tubing to the surface.

BRIEF DESCRIPTION OF THE DRAWINGS

The invention may be carried into practice in a number of ways but one specific embodiment will now be described by way of example with reference to the accompanying drawings, in which.

DETAILED DESCRIPTION OF THE PREFERRED EMBODIMENT

Figure 1:
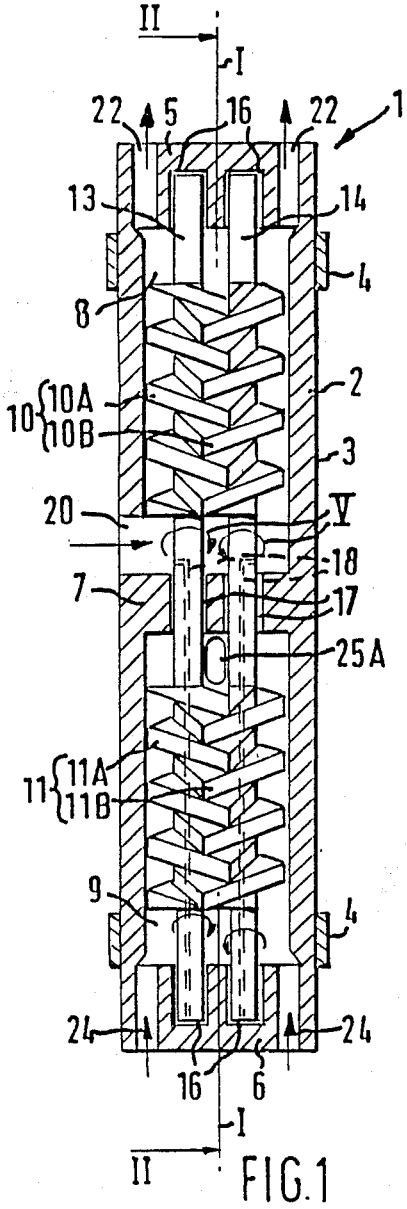
FIG. 1 is a longitudinal cross-section of a pumping apparatus according to the invention.
Figure 3:
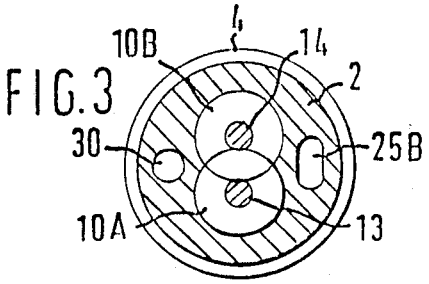
FIG. 3 is a cross-section of the apparatus seen in the direction of arrows III in FIG. 2.
Figure 2:
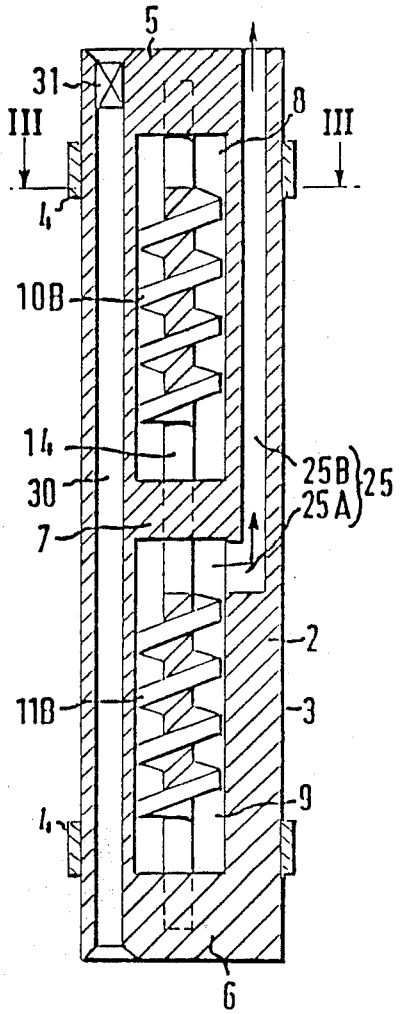
FIG. 2 is a longitudinal cross-section of the pumping apparatus taken along line I—I in FIG. 1 and seen in the direction of arrows II.

The pumping apparatus shown in FIGS. 1-3 comprises a housing 1 with a longitudinal axis I—I and a side wall 2 having a cylindrical outer surface 3 arranged coaxial to said axis I—I. On the outer surface 3 of the side wall 2 there are mounted two inflatable packers 4 or other suitable devices for securing the apparatus at a selected downhole location inside a production string (not shown) within a well from which a fluid, such as crude oil, is produced. The housing 1 further comprises upper and lower terminal walls 5 and 6, respectively, and an intermediate wall 7, which walls are substantially flat and arranged cross-axial to the longitudinal axis I—I. The intermediate wall 7 is located in the middle of the housing 1 and divides the housing interior into an upper compartment 8 and a lower compartment 9. The upper housing compartment 8 comprises the motor section consisting of a twin rotor screw type positive displacement motor 10, whereas the lower housing compartment 9 comprises the pump section consisting of a twin rotor screw type positive displacement pump 11. The motor section 10 comprises a pair of cooperating screw rotors 10A and 10B, and the pump section 11 comprises a similar pair of cooperating screw rotors 11A and 11B. The screw rotors 10A and 11A shown at the left side of FIG. 1 are identical in diameter and helix angle and they are mounted on a common shaft 13, whereas the screw rotors 10B and 11B shown at the right side of FIG. 1 are also identical in diameter and helix angle and mounted on a common shaft 14. The helix angles of the cooperating pairs of screw rotors 10A, 10B and 11A, 11B, respectively, are opposite to each other and the axes of rotation of the shafts 13 and 14 are parallel to each other and to the longitudinal axis I—I.

The shafts 13 and 14 are supported by bearings 16 in the upper and lower terminal walls 5, 6 and pierce through openings 17 in the intermediate wall 7. The openings 17 may be provided with sealing rings (not shown) to avoid fluid leakage between the upper and lower compartment 8 and 9 and they further may comprise a bearing assembly (not shown) for laterally supporting the shafts 13, 14.

The bearing assembly and the bearings 16 may be of any suitable type and it is preferred to lubricate the bearings with clean drive fluid derived from the upper motor compartment 8. In order to facilitate lubrication of the bearings 16 in the lower terminal wall 6 the shafts 13 and 14 are each provided with a bore 18 forming a fluid communication between the upper compartment 8 and the bearings 16 in said lower wall 6. Alternatively, clean drive fluid can be supplied to the lower bearings 16 through a suitable passage (not shown) in the housing. Furthermore, by means of drillings (not shown) in the screw rotors 11A, 11B, communicating with the bores 18, clean drive fluid can be introduced into close clearance points at the rotor tips, further preventing damage by sand and other erosive matter.

As the pairs of screw rotors 10A, 11A and 10B, 11B mounted on each shaft 13, 14 are identical in diameter and helix angle, the axial thrusts are inherently in balance thus avoiding a substantial thrust bearing on the shafts 13, 14.

During normal operation of the pumping apparatus in a well, driving fluid is injected into the upper compartment 8 via a driving fluid inlet port 20 passing through the side wall 2 of the apparatus 1 at a location immediately above the intermediate wall 7. Said injection causes the drive fluid to move in upward direction through the upper compartment 8 towards a pair of driving fluid outlet ports 22 in the upper terminal wall 5, thereby actuating the screw rotors 10A, 10B of the motor, and simultaneously the shafts 13, 14 and screw rotors 11A, 11B, to rotate in opposite directions, as indicated by arrows V. The manner in which the drive fluid actuates the screw rotors 10A, 10B of the twin rotor screw type motor is known per se and does not require a detailed description.

Said rotation of the screw rotors 11A, 11B of the screw pump 11 induces well fluid to be sucked into the lower compartment 9 via a pair of production fluid inlets 24 in the lower terminal wall 6 and to be subsequently pumped in an upward direction through the lower compartment towards a production fluid outlet consisting of a conduit 25 discharging into the interior of the production tubing section (not shown) above the upper terminal wall 5. As illustrated in FIGS. 2 and 3, the conduit 25 forms a bypass along the upper compartment 8 of the apparatus and comprises a radial section 25A which is in fluid communication with the section of the interior of the lower compartment 9 adjacent to the intermediate wall 7 and an axial section 25B extending through a longitudinal bore in the side wall 1 of the housing.

The apparatus is installed in a production tubing (not shown) of a well in the following manner. The apparatus is connected to a wireline tool and lowered through the tubing to a selected depth where in opening has been shot through the tubing wall, which opening forms a fluid passage from an annular space surrounding the tubing and the tubing interior. The apparatus is subsequently anchored to the tubing wall by inflating the packers 4 on the side wall 2 thereof after checking that said opening in the tubing wall is located between the packers 4. In this manner the driving fluid inlet 20 is brought in fluid communication with the annular space around the tubing, while the apparatus divides the interior of the tubing in a lower tubing section extending between the well production zone and the lower terminal wall 6 of the apparatus and an upper tubing section extending from the upper terminal wall 5 of the apparatus towards the wellhead. Alternatively, the apparatus may be located and supported in the production tubing by allowing it to rest on suitably located projections arranged in the base of the said tubing.

After having thus installed the apparatus in the well tubing the apparatus is disconnected from the wireline tool and pumping is started by injecting a drive fluid by pumping means located at the well head via the annular space and said opening in the tubing wall into the driving fluid inlet 20, thereby activating the screw rotors 10A, 10B of the motor section 10 to rotate the shafts and the screw rotors 11A, 11B of the pump section 11 in the directions illustrated by arrows V. As described hereinbefore, said rotation causes the screw rotors 11A, 11B of the pump section 11 to suck the well fluids from the lower tubing section via the production fluid inlet ports 24 into the lower compartment 9 and to subsequently pump the well fluids in upward direction via the production fluid outlet 25 into the upper tubing section located above the apparatus 1. In the upper tubing section the production fluid is mixed with the drive fluid and transferred to the wellhead. It is preferred to use recirculated production fluid as driving fluid and to filter solid particles such as sand from the production fluid before reinjecting it into the well as a clean driving fluid. The reinjected production fluid may be mixed up with other fluids such as gasoline if the viscosity of the produced fluid is too high to allow it to be used as driving fluid. If the produced fluid is not suitable to be used as driving fluid then the driving fluid should not be mixed up with the production fluid in the production string, but should be transferred back to the wellhead via a separate return conduit connected to the driving fluid outlet 21 of the apparatus and located in the interior of the production tubing. Moreover, instead of using the well annulus as conduit for injecting driving fluid, a separate supply conduit may be installed in the production tubing to supply the driving fluid to the apparatus. In this manner a closed circuit can be created through which drive fluid is circulated from the pumping means at the wellhead to the downhole pumping apparatus and vice versa. The driving fluid supply and exhaust conduits that form the circuit may be suspended within the production tubing as a pair of coaxial pipes.

As illustrated in FIGS. 2 and 3 the apparatus is provided with a longitudinal passage 30 to enable lowering and raising of wireline tools through the production tubing to the production zone while the apparatus 1 is present inside the tubing. The longitudinal passage 30 extends through a bore in the side wall 2 of the apparatus and is provided near the upper end thereof with a plug 31 which can be removed when a wireline tool is lowered through the tubing. If desired, the removable plug 31 may be replaced by a valve (not shown) which is normally open but closes automatically if the apparatus is activated to pump well fluids to the surface.

The pumping apparatus according to the invention may be used to pump single or multiphase fluids to the surface such as mixtures of hydrocarbon fluids containing crude oil and natural gas, while the produced fluids may contain solid particles, such as sand, without giving rise to a largely increased wear rate of the apparatus.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the present invention.

What is claimed is:

1. A downhole apparatus for producing well fluids from a reservoir, said apparatus being suitable for mounting within a production tubing surrounded by a well annulus and comprising:

a housing having an intermediate wall dividing the housing into an upper compartment and a lower compartment;

a twin rotor screw type positive displacement motor within the upper compartment of the housing, comprising:

a driving fluid inlet disposed for communication with the well annulus;
a driving fluid outlet; and
a pair of screw rotors of said motor positioned between said driving fluid inlet and said driving fluid outlet;
a twin rotor screw type positive displacement pump within the lower compartment of the housing, comprising:
a production fluid inlet in communication with the producing formation;
a production fluid outlet conduit extending through a longitudinal bore within the housing which exits the lower compartment of the housing and forms a bypass along the upper compartment of the housing; and a pair of screw rotors of said pump positioned between said production fluid inlet and said production fluid outlet conduit; and
a pair of parallel shafts rotatably mounted in the housing, each shaft carrying one of the screw rotors of said pump and one of the screw rotors of said motor.

2. The apparatus of claim 1, wherein the screw rotors of said pump and motor which are mounted on common shafts are identical in diameter and helix angle.

3. The apparatus of claim 2, wherein the housing has a longitudinal axis parallel to said shafts, further comprising:
a side wall with a coaxial cylindrical outer surface; and
cross-axial upper and lower terminal walls and a cross-axial orientation to the intermediate wall;
wherein said shafts pass through openings in said intermediate wall and are rotatably supported by bearings in the upper and lower terminal walls.

4. The apparatus of claim 3, wherein the production fluid inlet consists of an inlet port passing through the lower terminal wall of the housing and the driving fluid outlet consists of an outlet port passing through the upper terminal wall of the housing.

5. The apparatus of claim 4 wherein the driving fluid inlet consists of a driving fluid inlet port passing through the side wall of the housing into the interior of the upper compartment at a location adjacent to the intermediate wall.

6. The apparatus of claim 5, wherein a pair of inflatable annular packers are mounted on the outer surface of the side wall of the housing at opposite sides of the driving fluid inlet port.

7. The apparatus of claim 6, wherein provisions are made to accept a wireline tool, said apparatus comprising:
a longitudinal passage extending through the housing wall forming a bypass along both the upper and lower compartment for lowering and raising the well logging tool through the apparatus, said passage being closed off by a removable plug means.

8. The apparatus of claim 7, wherein the upper terminal wall of the housing is adapted to be connected to a wireline tool for raising and lowering the apparatus through a well production tubing.

9. A downhole apparatus for producing well fluids which is suitable for mounting within a production tubing surrounded by a well annulus, said downhole apparatus comprising:
a longitudinal housing comprising:
a side wall with a coaxial cylindrical outer surface;
a cross-axial upper terminal wall;
a cross-axial lower terminal wall; and
a cross-axial intermediate wall dividing the housing into an upper compartment and a lower compartment;
a twin rotor screw type positive displacement motor within the housing, comprising:
a driving fluid inlet port passing through the side wall of the housing into the interior of the upper compartment at a location adjacent to the intermediate wall;
a driving fluid outlet passing through the upper terminal wall of the housing; and
a pair of screw rotors of said motor positioned between said driving fluid inlet port and said driving fluid outlet port;
a twin rotor screw type positive displacement pump within the lower compartment of the housing, comprising:
a production fluid inlet port passing through the lower terminal wall of the housing;
a production fluid outlet conduit extending through a longitudinal bore in the side wall of the housing, said bore forming a bypass along the upper compartment; and
a pair of screw rotors of said pump positioned between said production fluid inlet port and said production fluid outlet conduit;
a pair of parallel shafts rotatably mounted within the housing parallel to the longitudinal axis thereof and passing through openings defined in said intermediate wall, each shaft carrying one of the screw rotors of said pump and one of the screw rotors of said motor; and
a pair of inflatable annular packers mounted on the outer surface of the side wall of the housing at opposite sides of the driving fluid inlet port.

10. The apparatus of claim 9, wherein the screw rotors of said pump and motor which are mounted on common shafts are identical in diameter and helix angle.

11. The apparatus of claim 9, wherein provisions are made to accept a wireline tool, said apparatus comprising:
a longitudinal passage extending through the housing wall forming a bypass along both the upper and lower compartment for lowering and raising the well logging tool through the apparatus, said passage being closed off by a removal plug means.

12. The apparatus of claim 11, wherein the upper terminal wall of the housing is adapted to be connected to a wireline tool for raising and lowering the apparatus through the production tubing.

13. A method of producing fluids from a well using a fluid driven downhole apparatus, the method comprising:
lowering the apparatus through a production tubing in the well;
anchoring the apparatus at a selected depth inside said tubing;
bringing a production fluid inlet and a production fluid outlet into fluid communication with the interior of a tubing section below and above the apparatus, respectively;
bringing a driving fluid inlet into fluid communication with a well annulus surrounding the tubing;
injecting a driving fluid via the well annulus into the driving fluid inlet; and driving a twin rotor screw type positive displacement motor by passing the driving fluid received from the well annulus to a driving fluid outlet through a pair of screw rotors of the motor, thereby rotating a pair of parallel shafts on which the screw rotors of the motor are mounted and driving a pair of screw rotors of a twin rotor screw type positive displacement pump mounted on the other end of the parallel shafts, whereby well fluids are pumped to the surface via the production tubing.

14. A fluid-driven downhole apparatus for pumping a fluid from a well, comprising:

a longitudinal housing comprising:

a side wall with a coaxial cylindrical outer surface;

a cross-axial upper terminal wall;

a cross-axial lower terminal wall; and a cross-axial intermediate wall dividing the housing into an upper compartment and a lower compartment;

a twin rotor screw type positive displacement motor within the upper compartment of the housing, comprising:

a driving fluid inlet port passing through the side wall of the housing into the interior of the upper compartment at a location adjacent to the intermediate wall;

a driving fluid outlet;

a pair of screw rotors of said motor positioned between said driving fluid inlet port and said driving fluid outlet port;

a twin rotor screw type positive displacement pump within the lower compartment of the housing, comprising:

a production fluid inlet port passing through the lower terminal wall of the housing;

a production fluid outlet conduit extending through a longitudinal bore in the side wall of the housing, said bore forming a bypass along the upper compartment; and a pair of screw rotors of said pump positioned between said production fluid inlet port and said production fluid outlet conduit;

a pair of parallel shafts rotatably mounted within the housing parallel to the longitudinal axis thereof and passing through openings defined in said intermediate wall, each shaft carrying one of the screw rotors of said pump and one of the screw rotors of said motor which are identical in diameter and helix angle and each shaft being supported by bearings in the upper and lower terminal walls; and a pair of inflatable annular packers mounted on the outer surface of the side wall of the housing at opposite sides of the driving fluid inlet port.

15. The apparatus of claim 14, wherein provisions are made to accept a wireline tool, said apparatus comprising:

a longitudinal passage extending through the housing wall forming a bypass along both the upper and lower compartment for lowering and raising the well logging tool through the apparatus, said passage being closed off by a removal plug means.

16. The apparatus of claim 15, wherein the upper terminal wall of the housing is adapted to be connected to a wireline tool for raising and lowering the apparatus through the production tubing.

17. A method of producing fluids from a well using a fluid driven downhole apparatus, the method comprising:

lowering the apparatus through a production tubing in the well;

anchoring the apparatus at a selected depth inside said tubing;

bringing a production fluid inlet and a production fluid outlet into fluid communication with the interior of a tubing section below and above the apparatus, respectively;

bringing a driving fluid inlet into fluid communication with a well annulus surrounding the tubing;

injecting a driving fluid which is free of particulate material via the well annulus into the driving fluid inlet; whereby the apparatus is actuated to pump well fluids via the production tubing to the surface; and injecting the driving fluid via bores communicating with the driving fluid inlet into wear-prone parts of the apparatus such as the bearings and close clearance points in the pump section of the apparatus.

18. The method of claim 17, further comprising exhausting the driving fluid from the driving fluid outlet into the interior of the tubing above the apparatus.

19. The method of claim 17, wherein injecting a driving fluid comprises injecting fluid produced from the well.

* * * * *